US009039591B2

(12) United States Patent
Welp

(10) Patent No.: US 9,039,591 B2
(45) Date of Patent: May 26, 2015

(54) BAG MANUFACTURING SYSTEM WITH A STORAGE DEVICE FOR STORING TUBE PIECES

(75) Inventor: Hans-Dieter Welp, Lengerich (DE)

(73) Assignee: WINDMOELLER & HOELSCHER KG, Lengerich (DE)

( * ) Notice: Subject to any disclaimer, the term of this patent is extended or adjusted under 35 U.S.C. 154(b) by 485 days.

(21) Appl. No.: 11/579,484

(22) PCT Filed: May 4, 2005

(86) PCT No.: PCT/EP2005/004961
§ 371 (c)(1),
(2), (4) Date: Nov. 3, 2006

(87) PCT Pub. No.: WO2005/105421
PCT Pub. Date: Nov. 10, 2005

(65) Prior Publication Data

US 2008/0274867 A1 Nov. 6, 2008

(30) Foreign Application Priority Data

May 4, 2004 (DE) ..... 10 2004 022 291

(51) Int. Cl.
*B31B 49/04* (2006.01)
*B31B 1/98* (2006.01)
*B31B 29/00* (2006.01)

(52) U.S. Cl.
CPC . *B31B 1/98* (2013.01); *B31B 29/00* (2013.01); *B31B 2201/927* (2013.01); *B31B 2221/20* (2013.01)

(58) Field of Classification Search
USPC ..... 493/195, 269, 310, 276, 287, 288, 308; 271/185, 186, 210
See application file for complete search history.

(56) References Cited

U.S. PATENT DOCUMENTS

| | | | | |
|---|---|---|---|---|
| 4,871,347 | A | 10/1989 | Brinkmeier | |
| 5,827,165 | A | 10/1998 | Achelpohl et al. | |
| 6,247,694 | B1 * | 6/2001 | Nonnemacher et al. | 271/146 |
| 6,296,600 | B1 * | 10/2001 | Drummond et al. | 493/276 |
| 6,511,281 | B2 * | 1/2003 | Graeler | 414/791.6 |
| 6,558,306 | B2 * | 5/2003 | Lowry et al. | 493/276 |
| 7,361,130 | B2 * | 4/2008 | Ahlers et al. | 493/269 |
| 7,452,318 | B2 * | 11/2008 | Gelli et al. | 493/269 |

FOREIGN PATENT DOCUMENTS

| | | | |
|---|---|---|---|
| DE | 1611712 | | 1/1971 |
| DE | 36 40 219 | C1 | 1/1988 |
| DE | 43 33 906 | A1 | 4/1995 |
| DE | 44 40 660 | A1 | 5/1996 |
| DE | 197 33 240 | A1 | 2/1999 |
| DE | 195 49 618 | C2 | 9/2001 |
| DE | 100 58 625 | A1 | 6/2002 |
| EP | 0 711 724 | A1 | 5/1996 |
| EP | 0 894 754 | A1 | 2/1999 |
| JP | 11 129359 | | 5/1999 |

* cited by examiner

*Primary Examiner* — Sameh Tawfik
(74) *Attorney, Agent, or Firm* — Jacobson Holman, PLLC

(57) ABSTRACT

A bag manufacturing system has at least one tube forming device which forms a tube and separates the tube into tube pieces, and at least one bottom forming device which provides the tube pieces with a bottom and thus forms the bags. The system has a storage device for storing the tube pieces on at least two levels. At least two charging and removing devices are provided with which the tube pieces can be supplied to and/or removed from at least two different points of the levels of the storage device.

15 Claims, 3 Drawing Sheets

BAG MANUFACTURING SYSTEM WITH A STORAGE DEVICE FOR STORING TUBE PIECES

CROSS-REFERENCE TO RELATED APPLICATION

This is a nationalization of PCT/EP2005/004961 filed 4 May 2005 and published in German.

BACKGROUND OF THE INVENTION

1. Field of Invention

The invention relates to a bag manufacturing system that includes a tube forming device, which forms a tube and then separates the tube into tube pieces, a bottom forming device, which provides the tube pieces with bottoms so as to form bags, and a storage device for storing the tube pieces on at least two tiers.

2. Description of the Prior Art

As a rule, endless tubes are initially formed in a very efficient manner in so-called tube machines for manufacturing bags. For this purpose a web, which was made of paper or plastic and was delivered mostly on a roll, is first folded up into a tube and the web edges, which are now located on top of one another, are joined using suitable joining means, for example, an adhesive. In doing so, the joining seam is usually located parallel to the transport direction of the tube. Multiply tubes as required, for example, for manufacturing cement bags, can also be produced by laying several webs on top of one another before the actual tube forming. Following the tube forming, the tube is separated into tube pieces and transported away individually or preferably in stacks. A device for forming such tube pieces is disclosed, for example, in the patent specifications DE 36 40 219 C1 and DE 44 40 660 C2.

The pieces of tube produced in such a way are frequently supplied to another device, the bottom forming device, in which the former are processed further into pouches or bags. For this purpose, a bottom was molded on at least one end of a tube piece. Thus, for example, such devices for forming cross bottom valve bags are known, in which bottoms are molded even on both the ends of the tube pieces. The patent specification DE 195 49 618 C2 shows the pulling open of the ends of a tube piece. The finished bags are also regarded as tube pieces in the language used in this patent application.

Such a bottom forming device works without any disturbances especially if the tube pieces are as flat as possible. However, in practice such tube pieces are strongly corrugated especially in the region of the joining seam. This can be attributed to the fact that the joining material is not yet completely dry when leaving the tube machine. This is the case especially when using highly moisture-retaining starch-based adhesive. Therefore in the past the tube pieces were put into interim storage in a storage device before the subsequent processing. During the storage period, the tube pieces, which are frequently stored as a stack in such a storage device, are provided with a press plate so that the tube pieces assume the most planar possible position while the joining material dries off or hardens, and maintain this position even after leaving the storage device.

The laid-open specification DE 43 33 906 A1 shows such a storage device. This device comprises several tiers on which the tube pieces are stored with the help of a loading and unloading device. A press plate is assigned to every tier, with which press plate the tube pieces are compressed. The tube pieces are removed later from the tiers with the help of the loading and unloading device for the purpose of subsequent processing.

However, it has proved to be disadvantageous that the loading and unloading device, which is arranged stationarily on one side of the tiers, is required both for supplying and also for removing the tube pieces. However, this restricts the production flow and the effectiveness of the generic system since the loading and unloading device cannot supply any tube pieces when other tube pieces are being removed and vice versa.

SUMMARY OF THE INVENTION

It is therefore the object of the present invention to suggest a bag manufacturing system, which prevents the afore-mentioned disadvantages.

This object is achieved according to the various embodiments of the invention described herein.

Thus the present invention is characterized in that at least two loading and unloading devices are provided, with which the tube pieces can be removed from or supplied to the tiers of the storage device at least two different points on the storage device. The tiers are arranged on top of one another and are designed to be angular—preferably square or rectangular. The loading and unloading devices can then be easily designed as lifts. Often one of the loading and unloading devices works exclusively as a loading device while the second of the loading and unloading devices works exclusively as an unloading device. Advantageously, the loading and unloading devices are arranged on mutually opposing sides, preferably the short sides of the tiers. This ensures an especially effective production flow. Furthermore, in order to also enable a flexible use of the system, at least five, especially eight tiers are provided in which tube pieces can be stored. It is thus possible to load a tier of the storage unit with a production lot from the tube machine while the bottom forming device is supplied with tube pieces from another production lot, for example with another tube piece format, which was already stored in the storage device for a long time.

A system according to the invention further comprises means for transporting the tube pieces from the tube machine to the bottomer. These means for transport are preferably designed to be stationary and are usually operated automatically, especially fully automatically. The means for transport also comprise unending, circumferential transport elements, such as for example, conveyor belts, transport rollers or belt conveyors. One part of these transport elements can be arranged on or at the tiers of the storage device so that the tube pieces are also transported inside the storage device without having to be grasped or collected by any of the loading and unloading devices as was the procedure from the prior art. The transport elements preferably transport the tube pieces intermittently. In this way it is possible to arrange and also to compress several tube pieces or stacks successively on one tier in the transport direction. The width of the storage device is dimensioned such that several, for example, three tube pieces or stacks can be stored side by side. All in all, the tube pieces can be arranged in the tiers in very different storage patterns.

In one embodiment of the system, the tube pieces are transported in the substantially same transport direction inside the tube machine, inside the storage unit and inside the bottom forming device. The transport directions in the three afore-mentioned devices are thus located substantially parallel to one another. Naturally, the transport directions can deviate from the parallelism within a certain scale without the inventive thought being constricted thereby. Such an arrangement can be advantageously realized in a long, narrow production hall.

In another embodiment, the transport directions in the tube machine and in the storage device are located perpendicularly to one another. The transport direction in the bottom forming device can be located perpendicularly to the transport direction inside the storage device. This arrangement of the three afore-mentioned devices is advantageous for a short, but wide production hall.

A deflection device is advantageously provided inside a system according to the invention, which deflection device changes the orientation of the tube pieces in relation to the transport direction. This is advantageous especially in the arrangements described above, since the tube piece is frequently transported in a bottom forming device with its longitudinal axis transversely to the transport direction. The deflection device is preferably arranged such that the tube pieces are also located inside the storage device with their longitudinal axis transversely to the transport direction. Depending on the arrangement of the three afore-mentioned devices, the deflection device can be located between the tube machine and the storage device and/or between the storage device and the bottom forming device.

Additional exemplary embodiments of the invention are specified in the present description and claims.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
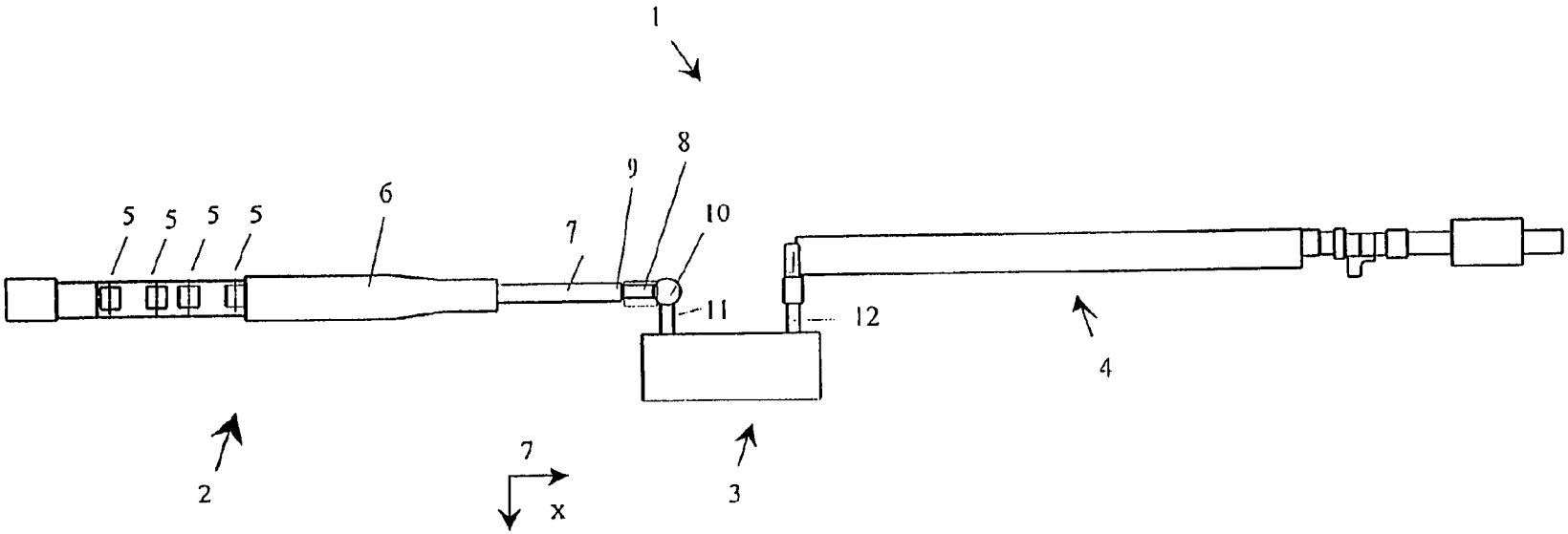
FIG. 1 a plan view of an embodiment of the system according to the invention FIG. 2 a plan view of a second embodiment of the system according to the invention FIG. 3 a lateral view of a storage device

FIG. 1 shows a first embodiment of a bag manufacturing system according to the invention, which, taken as a whole, is indicated with the reference numeral 1. The essential components of the system 1 are a tube machine 2, a storage device 3 and a bottom forming device 4. The tube machine 2 comprises at least one or several unwinders 5 as its most important components. These unwinders 5 can be equipped with rolls of paper or plastic. The webs are unwound in the unwinders 5 and supplied to the tube forming station 6 with the help of deflecting and guiding elements (not illustrated). Inside this tube forming station, the edges of the webs are placed on top of one another and joined to one another and/or possibly to other existing webs. After passing through the tube forming station 6, the tube is separated in a separating device 7 into tube pieces 8, wherein the tube is initially perforated and then tube pieces 8 are torn off from the tube in a tear-off unit, as shown, for example, in DE 44 40 660 C2. Several tube pieces 8 can be stacked into a tube stack. The longitudinal axes of the tube pieces 8 are located in their transport direction z.

The tube pieces 8 are supplied using a transport device 9, a rotary table 10 and another transport device 11 to the storage device 3. The location of the longitudinal axes of the tube pieces 8 is rotated by 90 degrees on the rotary table 10 so that the longitudinal axis is now located in the x direction. However, the tube pieces 8 are again transported in the transport direction z inside the storage device 3. The longitudinal axis of the tube pieces 8 is thus located transversely to the transport direction z. The tube pieces 8 are stored and simultaneously pressed inside the storage device 3. The operating mode of the storage unit 3 is explained in detail below.

After passing through the storage device 3, the tube pieces 8 are supplied using another transport device 12 to the bottom forming device 4, wherein the tube pieces 8 are again transported in the direction of their longitudinal axis, thus in the −x direction. The tube pieces 8 are again transported transversely to their longitudinal axis in the transport direction z inside the bottom forming device, the operating mode of which will not be explained in detail.

The illustrated arrangement of the tube machine 2, the storage device 3 and the bottom forming device 4 is selected advantageously when it is intended to install a bag manufacturing system in a long, narrow production hall. The transport directions of the tube pieces 8 are located substantially parallel to one another inside the three components of the system, thus inside the tube machine 2, the storage device 3 and the bottom forming device 4.

Figure 2:
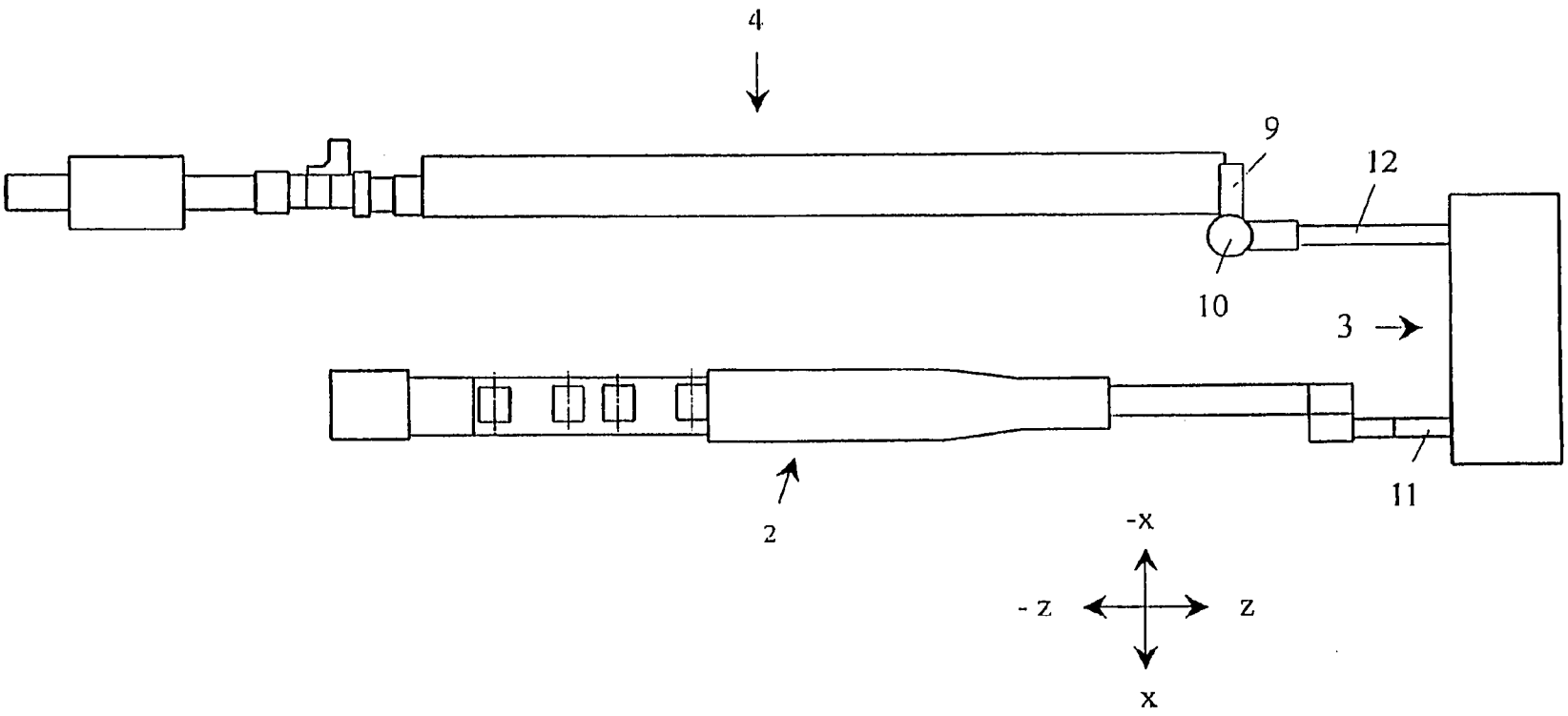

However, if a short, but wider production hall is available, then the embodiment shown in FIG. 2 can be selected. Unlike the system selected in FIG. 1, the transport direction of the tube pieces 8 inside the storage device 3 is not located in the transport direction z, instead in the −x direction, thus transversely to the transport direction inside the tube machine 2. Another equivalent to this would be a transport of the tube pieces 8 in the x direction inside the storage unit. In this arrangement also, the tube pieces 8 are transported transversely to their longitudinal axis inside the storage device 3. Nonetheless, it must be pointed out that the longitudinal axis of the tube pieces can also be located parallel to the transport direction.

The storage device 3 is followed by a transport device 9, a rotary table 10 and another transport device 11, which supply the tube pieces to the bottom forming device 4. The transport direction (−z direction in the case illustrated) of the tube pieces 8 in the bottom forming device is located in turn transversely to the transport direction x, −x of the tube pieces 8 in the storage device 3.

Figure 3:
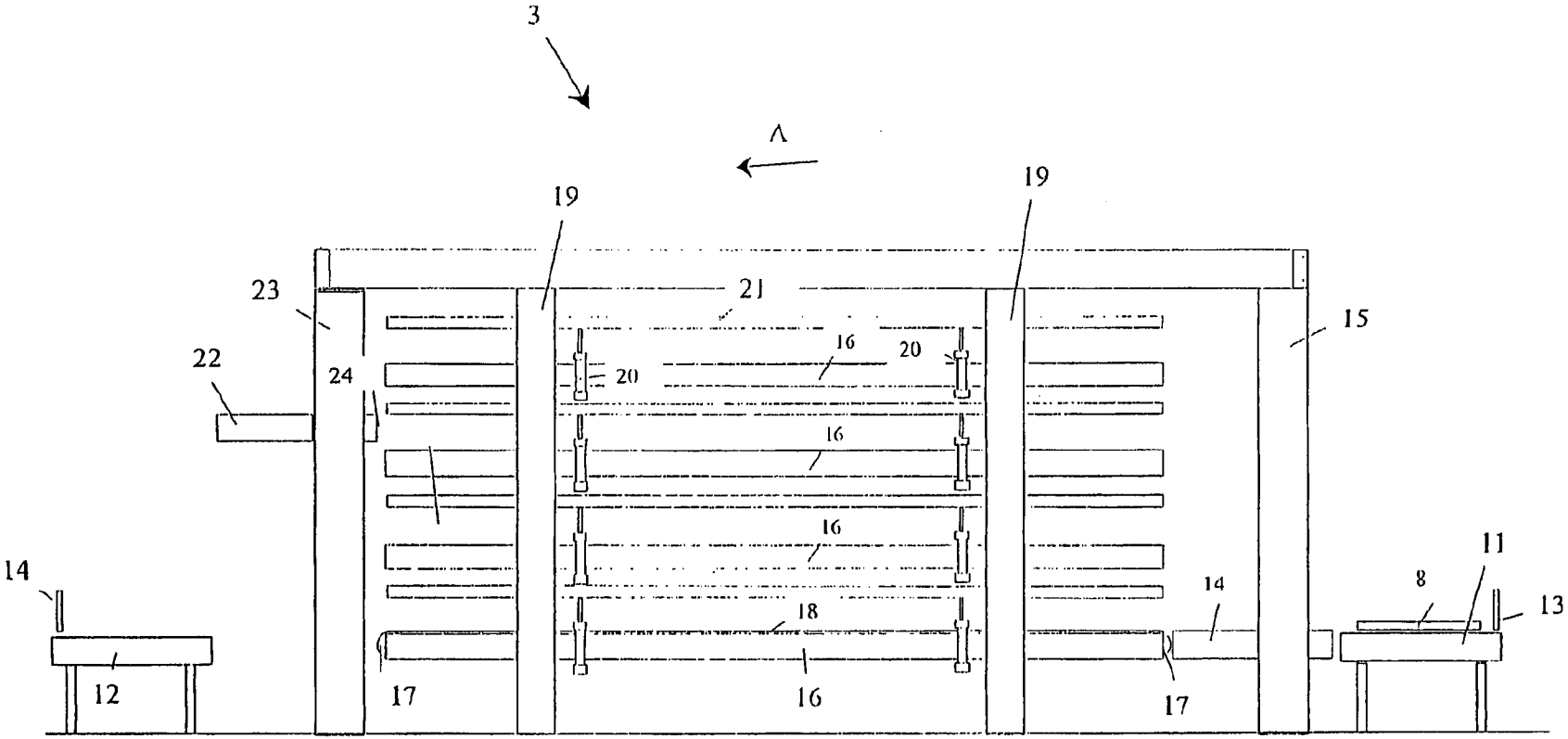

FIG. 3 shows a lateral view of a storage device 3 as used in a system according to the invention. The tube pieces 8 are brought using the transport device 11 to the storage device 3. The tube pieces 8 are transported using a cross slide 13 to a loading and unloading device designed as a lifting table 14. This lifting table 14 can be moved along the vertical support 15 in a manner that is not explained in detail. Once the lifting table 14 has reached the height of the tiers 16, on which the tube pieces 8 are supposed to be stored, the tube piece 8 is handed over. For this purpose, the lifting table 14 is equipped with conveyor belts (not visible), which transport the tube pieces 8 in the transport direction indicated with the letter A for the purpose of explaining the operating mode of the storage device 3. The tiers 16 are equipped with deflecting rollers 17, which are driven in a manner that is not explained in detail and which guide at least one conveyor belt 18 in each case. The deflecting rollers 17 and conveyor belts 18 are drawn by way of example only at the lowermost tier 16. The conveyor belts 18 transport the tube pieces 8 in direction A after being taken over from the lifting table 14 until they have left the lifting table completely. However, the tube pieces 8 are transported further only if additional tube pieces 8 are supposed to be stored on the same tiers 16 and/or if the stored tube pieces 8 are supposed to be supplied to the subsequent processing device. The tiers 16 are attached to supports 19 such that they are fixed to the frame of the latter. Actuators 20 are attached laterally to the tiers 16 for compressing the tube pieces 8, the press plates 21 being supported on the actuators. The actuators 20 can thus raise the corresponding press plate 21 when tube pieces 8 on the desired tier 16 are supposed to be transported. The actuators 20 are thus started up for compressing the tube pieces 8 so that the press plates 21 compress the tube pieces 8 by their self-weight. Though only one press plate 21 is illustrated for each tier 16 in FIG. 3, several press plates for each tier 16 are also feasible so that tube pieces 8 or stacks of tube pieces can also be compressed optimally at different heights.

The tube pieces 8 are transported away from the storage unit using a loading and unloading device, which is also designed as a lifting table 22, which can move along the vertical support 23. The tube pieces are delivered from the lifting table 22 in the transport device 12.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

List of reference symbols

| | |
|---|---|
| 1 | Bag manufacturing system |
| 2 | Tube machine |
| 3 | Storage device |
| 4 | Bottom forming device |
| 5 | Unwinders |
| 6 | Bottom forming station |
| 7 | Separating device |
| 8 | Tube piece |
| 9 | Transport device |
| 10 | Rotary table |
| 11 | Transport device |
| 12 | Transport device |
| 13 | Cross slide |
| 14 | Lifting table |
| 15 | Vertical support |
| 16 | Tier |
| 17 | Deflecting roller |
| 18 | Conveyor belt |
| 19 | Support |
| 20 | Actuators |
| 21 | Press plates |
| 22 | Lifting table |
| 23 | Vertical support |
| A | Transport direction inside the storage device |
| x | Transport direction of the tube pieces |
| y | Transport direction of the tube pieces |
| z | Transport direction of the tube pieces |

What is claimed is:

1. A bag manufacturing system comprising:

at least one tube forming device, which forms a tube and then separates the tube into tube pieces;

at least one bottom forming device, which provides the tube pieces as to form bags;

a storage device that stores the tube pieces on at least two tiers in a stack having a first side and a second side; and at least a first loading and unloading device and a second loading and unloading device that supply the tube pieces to and remove the tub pieces from at least a first point at the first side of the at least two-tiered stack and a second point at the second side of the at least two-tiered stack of the storage device, the first loading and unloading device and the second loading and unloading device each including a lifting table that (i) moves vertically to access the tiers of the stack and (ii) has associated therewith a conveyor belt that transports the tube pieces in a transport direction, with the first loading and unloading device supplying the tube pieces to the first point at a same time that the second loading and unloading device is removing the tube pieces from the second point.

2. The system according to claim 1, further comprising devices that transport the tube pieces from the tube forming de to the bottom forming device.

3. The system according to claim 2, wherein the devices that transport the tube pieces include unending, circumferential transport elements.

4. The system according claim 1, wherein the first loading and unloading device is connected to the at least one tube forming device using devices that transport the tube pieces and the second loading and unloading device is connected to the at least one bottom forming device using the devices that transport the tube pieces.

5. The system according to claim 1, wherein the first loading and unloading device is attached to a side of the storage device facing the at least one tube forming device and the second loading and unloading device is attached to a side of the storage device facing the at least one bottom forming device.

6. The system according to claim 5, further comprising devices that transport the tube pieces from the tube forming device to the bottom forming device, the devices that transport the tube pieces including transport elements that transport the tube pieces between the first and the second loading and unloading device.

7. The system according to claim 6, wherein the transport elements are at least in part unending circumferential transport elements.

8. The system according to claim 7, wherein the transport elements are belts.

9. The system according to claim 1, wherein the first and the second loading and unloading device are arranged on mutually opposing sides of the tiers.

10. The system according to claim 1, wherein the at least one tube forming device and the at least one bottom forming device are arranged one behind the other, and a transport direction (z) of the tube pieces in the bottom forming device and in the tube machine run substantially parallel.

11. The system according to claim 1, further comprising at least one deflecting device, which changes an orientation of the tube pieces in relation to transport directions (x, −x, z, −z) and which is arranged between the tube forming device and at least one of the storage device and the bottom forming device.

12. The system according to claim 11, wherein a transport direction (a) in the storage device is substantially parallel to the transport directions (x, −x, z, −z) in the tube forming device and in the bottom forming device.

13. The system according to claim 1, wherein the at least one tube forming device and the at least one bottom forming device are arranged such that transport directions (x, −x, z, −z) of the tube pieces in the bottom forming device and the tube forming device run substantially parallel, the transport direction (z) of the tube pieces in the tube forming device running inversely to the transport direction (−z) of the tube pieces in the bottom forming device.

14. A bag manufacturing system comprising:

at least one tube forming device, which forms a tube and then separates the tube into tube pieces;

at least one bottom forming device, which provides the tube pieces with bottoms so as to form bags;

a storage device that stores the tube pieces on at least two tiers in a stack having a first side and a second side; and at least a first loading and unloading device and a second loading and unloading device that supply the tube pieces to and remove the tube pieces from at least the first side and the second side of the at least two tiers of the storage device, the first loading and unloading device and the second loading and unloading device each including a lifting table that (i) moves vertically to access the tiers of the stack and (ii) has associated therewith a conveying element that transports the tube pieces horizontally in a transport direction, the first and second loading and unloading devices being arranged on the mutually opposing sides of the at least two tiers, with the first loading and unloading device supplying the tube pieces to the first side and the second loading and unloading device removing the tube pieces from the second side, and with the first and second loading and unloading devices simulataneously loading and unloading the storage device.

15. The system according to claim 14, wherein the loaded first loading and unloading device supplies the tube pieces to the first side by unloading, and the unloaded second loading and unloading device removes the tube pieces from the second side by loading.

* * * * *